United States Patent [19]

Black

[11] 4,012,812

[45] Mar. 22, 1977

[54] DOUBLE LOCK TUFTING BUTTON

[75] Inventor: Stanley D. Black, Malden, Mass.

[73] Assignee: Wade Industries, Inc., Malden, Mass.

[22] Filed: Mar. 11, 1976

[21] Appl. No.: 665,962

[52] U.S. Cl. ..... 24/90 B; 24/230.5 TP; 24/102 T; 24/130; 5/356; 24/113 R

[51] Int. Cl.[2] ..... A44B 1/22; A44B 1/18

[58] Field of Search ..... 24/90 B, 102 T, 230.5 TP, 24/264, 130; 5/356

[56] References Cited

UNITED STATES PATENTS

| | | | |
|---|---|---|---|
| 108,739 | 10/1870 | Taylor | 24/230.5 TP |
| 205,402 | 6/1878 | Marcellus | 24/230.5 TP |
| 399,831 | 3/1889 | Burson | 24/230.5 TP |
| 2,016,157 | 10/1935 | Rosberger | 24/102 T |
| 3,654,671 | 4/1972 | Berning | 24/102 T |
| 3,829,935 | 8/1974 | Critchfield | 24/90 B |

*Primary Examiner*—Bernard A. Gelak

*Attorney, Agent, or Firm*—Jerry Cohen; Charles Hieken

[57] ABSTRACT

Tufting button with double series-lock hook entrance to prevent twine loop backing out through the entrance comprising symmetrical down-coming lips at the second lock to define a well for the final resting place of the twine loop and a further downwardly opening mouth opposing the opening formed between the two down-coming lips, the shank of the button hook containing the hook and such locks providing a one-way guiding surface towards the first lock to facilitate rapid installation of the twine loop by avoiding back and forth movement or fishing for the opening, the button hook providing high thickness for strength in the region of the second lock because of its low profile construction and in the case of fabric covered buttons, having a rough surface on the sidewalls to prevent slippage of fabric from the button back.

6 Claims, 1 Drawing Figure

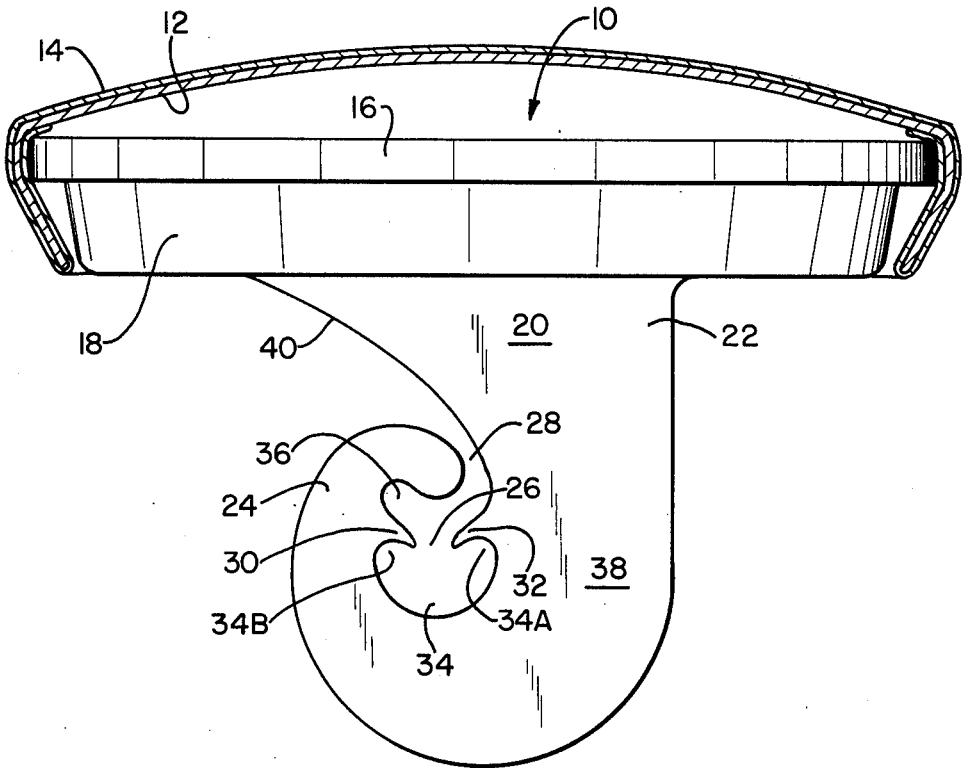
10
12
14
16
18
20
22
24
26
28
30
32
34
34A
34B
36
38
40

DOUBLE LOCK TUFTING BUTTON

BACKGROUND OF THE INVENTION

The present invention relates to tufting buttons suitable for pillows, mattresses, and upholstered furniture of the type generally contained in International Class A44*b*-1/18.

It is an important object of the invention to provide a tufting button collet assuring reliable locking of the twine loop conventionally used in upholstering therein.

It is a further object of the invention to provide easy looping to a collet stem consistent with the preceding object.

It is a further object of the invention to provide high strength consistent with one or both of the preceding objects.

It is a further object of the invention to provide sure gripping of a button shell on the collet consistent with one or more of the preceding objects.

It is a further object of the invention to provide a strong button hook shank without a significant increase in the overall dimensions or said shank consistent with one or more of the preceding objects.

The foregoing objects are achieved by a button construction in which the collet comprises a roughened sidewall, such as may be made by a rough mold to produce a collet sidewall with high surface roughness, of a degree known as "texture" roughness, made from a mold cut at least No. 3 roughness on the Society of Plastics Engineers 1–6 scale and preferably No. 6 to prevent fabric sliding thereon, but not so rough as to snag or tear shell fabric. The button collet has a stem depending therefrom which is hooked around to provide a first lock between a hook end and a lower shank portion of the stem and a second series lock comprising two down-coming lips depending from the hook and shank of the stem to define a twine residence cavity of symmetrical form with downwardly facing recesses straddling a locking opening defined between the two down-coming lips. The device further defines a downwardly (toward the second lock) facing cavity between the first and second locks. The hooked stem as a whole has a low profile allowing a large thickness of the shank in the portion adjacent the symmetric cavity without increasing the overall exterior dimensions of the shank which would cause an excessive hole in fabric or vinyl material.

Other objects, features and advantages of the invention will be apparent from the following detailed description of preferred embodiments when taken in connection with the accompanying drawing.

BRIEF DESCRIPTION OF THE DRAWING

The single FIGURE of which is a partial cross-section side view of a button assembly made in accordance with the preferred embodiment of the invention.

DETAILED DESCRIPTION OF PREFERRED EMBODIMENTS

A collet 10 is assembled with a shell 12, the latter being covered with fabric in accordance with the conventional tufting button design. The collet is made of plastic and comprises a base portion 16 and a lower portion 18 with roughened sidewalls (derived from a mold of No. 6 surface roughness). A plastic stem 20 depends from the collet and comprises a shank portion 22 and a hook portion 24 defining between them and a locking opening 28 as a first lock and a second locking opening 26 between down-coming lips 30 and 32 all integrally molded together and further defining a symmetric lower cavity 34 and a second downwardly facing cavity 36. The cavity 34 has downwardly opening recesses 34A and 34B straddling the opening 26 and the cavity 36 opposes the opening 26. The shank portion 38 indicated by a closed line has a wide thickness in the order of one-eighth inch to provide adequate strength in this critical stress area. A forward surface portion 40 of the shank hoods over the hook 24 to provide a one-way downward guiding surface towards opening 28 to avoid operator fishing for the locking opening. The widest portion of the shank 22 is 0.200 to 0.300, i.e., less than half the diameter of the 0.66 inch diameter base disc, and first locking opening 28 is 0.005 to 0.030 inches, preferably 0.01, the second locking opening 26 being 0/005 to 0.30 preferably 0.02 inches (for use with approximately 0.035 inch diameter twine). The collet base and stem are all of one-piece molded plastic with the hook end being sufficiently resilient for allowing the twine to pass through the locking openings when initially engaging the collet. The radius of curvature for blanding the stem into the hook is one-sixteenth – three-sixteenth inches and preferably about one-eighth inches and the overall width of the shank and hook is one-eighth – three-eighths, preferably one-fourth inches, the depth of the whole stem being about one-third inches, i.e., less than half the base disc diameter. Of the one-third inches the stem extends back 0.23 inches, i.e., over half, leaving about 0.1 inches for allowing the passage of the twine loop with the aid of guiding surface 40.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Tufting button comprising, a collet with a base disc and twine loop hook with first and second series array twine locks therein, the first lock being comprising a hook edge opposing a low stem portion of the hook and the second lock comprising symmetrically arranged opposing lips defining a locking opening therebetween overlying a cavity with symmetrically arranged return recesses under the lips on both sides of the locking opening, the device further comprising a return recess between the locks opposing the second lock opening, the arrangement providing one way twine locking movement whereby the twine can first contact a portion of the stem near the base disc, then go through said first lock and then go through said second lock in one continuous forward motion.

2. Tufting button in accordance with claim 1 wherein the stem shank has a ramped surface hooding the hook portion of the stem to provide a one-way twine guide into the first lock.

3. Tufting button in accordance with claim 1 and further comprising a fabric covered button shell in combination therewith locked onto the collet base disc.

4. Tufting button in accordance with claim 3 wherein the base disc has a roughened portion of its sidewall to prevent sliding of the fabric covered shell thereon.

5. Tufting button in accordance with claim 1 with a maximum stem width less than half of base disc diameter.

6. Tufting button in accordance with claim 5 with a maximum stem depth of less than half of base disc diameter.

* * * * *